US012338087B2

(12) United States Patent
Horii

(10) Patent No.: US 12,338,087 B2
(45) Date of Patent: Jun. 24, 2025

(54) RETRACTABLE TRAY FIXING DEVICE AND FIXING METHOD

(71) Applicant: NEC Platforms, Ltd., Kawasaki (JP)

(72) Inventor: Yuji Horii, Kanagawa (JP)

(73) Assignee: NEC Platforms, Ltd., Kanagawa (JP)

( * ) Notice: Subject to any disclaimer, the term of this patent is extended or adjusted under 35 U.S.C. 154(b) by 380 days.

(21) Appl. No.: 18/090,245

(22) Filed: Dec. 28, 2022

(65) Prior Publication Data

US 2023/0219775 A1 Jul. 13, 2023

(30) Foreign Application Priority Data

Jan. 13, 2022 (JP) ..... 2022-003638

(51) Int. Cl.
*B65H 1/04* (2006.01)

(52) U.S. Cl.
CPC ..... *B65H 1/04* (2013.01); *B65H 2405/11164* (2013.01); *B65H 2405/12* (2013.01); *B65H 2405/121* (2013.01); *B65H 2801/06* (2013.01)

(58) Field of Classification Search
CPC ..... B65H 1/04; B65H 2405/1122; B65H 2405/112; B65H 2405/12; B65H 2405/121
See application file for complete search history.

(56) References Cited

U.S. PATENT DOCUMENTS 8,387,971 B2 * 3/2013 Sunohara ..... B65H 1/266 271/171
9,242,813 B2 * 1/2016 Abe ..... B65H 3/02
9,422,123 B2 * 8/2016 Maruta ..... B65H 1/04
9,511,961 B2 * 12/2016 Murashima ..... B65H 1/266
10,479,626 B2 * 11/2019 Koga ..... G03G 15/6529
2016/0009514 A1 * 1/2016 Tani ..... B65H 1/04 271/240

FOREIGN PATENT DOCUMENTS

| | | | |
|---|---|---|---|
| CN | 1841221 | A | 10/2006 |
| JP | H02-103032 | U | 8/1990 |
| JP | H04-132766 | U | 12/1992 |
| JP | H06-144598 | A | 5/1994 |
| JP | H08-301461 | A | 11/1996 |
| JP | 3600407 | B2 | 12/2004 |
| WO | 2015/194503 | A1 | 12/2015 |

OTHER PUBLICATIONS

JP Office Action for JP Application No. 2022-003638, mailed on Oct. 4, 2022 with English Translation.
TW Office Communication for TW Application No. 111149360, mailed on Jan. 2, 2025 with English Translation.

* cited by examiner

*Primary Examiner* — Patrick Cicchino
(74) *Attorney, Agent, or Firm* — Sughrue Mion, PLLC

(57) ABSTRACT

A latch operating portion, which is made of an elastically deformable constituent material, connected to a knob portion of a latch, and operated by an operator to insert and remove a claw portion provided at a latch beam portion into and from a through hole of trays, is provided, and in a case in which the knob portion is pushed toward a wall portion by a fingertip operation to elastically deform the constituent material, the latch operating portion separates the claw portion from the through hole, restores the elastically deformed constituent material to its original shape when the fingertip is released, and inserts the claw portion into the through hole.

10 Claims, 9 Drawing Sheets

RETRACTABLE TRAY FIXING DEVICE AND FIXING METHOD

This application is based upon and claims the benefit of priority from Japanese Patent Application No. 2022-003638, filed Jan. 13, 2022, the disclosure of which is incorporated herein in its entirety by reference.

TECHNICAL FIELD

The present disclosure relates to a retractable tray fixing device and a fixing method in which lengths of two trays can be adjusted depending on intended uses.

BACKGROUND ART

In paper feeding devices used in printers, copiers, scanners, and other devices for supplying paper, which perform processing such as printing and reading on cut paper, a so-called retractable tray including a mechanism that can freely contract or expand a paper storage space of the tray in accordance with the size of the paper may be used. Such a retractable tray has a fixing device that fixes the tray in its contracted or extended state.

For example, a paper feeding cassette disclosed in Japanese Unexamined Patent Application, First Publication No. H06-144598 (hereinafter Patent Document 1) has a configuration in which a cassette main body in which a sliding cassette, which is provided separately from a cassette body, is superimposed and slidably disposed on the cassette body in which cut paper is stored.

In addition, in the paper feeding cassette, a fixing portion is provided between the cassette body and the sliding cassette.

The fixing portion is provided with a plurality of recessed portions disposed at intervals in a sliding direction on a surface facing the cassette body and the sliding cassette, and a protruding portion selectively fitted into one of the recessed portions, and thus the size of a paper storage space in the cassette body can be adjusted in accordance with the size of the cut paper.

SUMMARY

Incidentally, in the paper feeding cassette disclosed Patent Document 1, when a fitting position of the recessed portions and the protruding portion in the fixing portion is adjusted, it is required to separate the sliding cassette from the cassette body in a vertical direction, which requires a space for position adjustment.

However, since the above-described paper feeding cassette may need to be installed in a limited narrow space, an installation place for a device may be restricted in order to secure a work space for performing fixation or release of the sliding cassette relative to the cassette body or due to considerations for securing the work space.

Further, as a fixing portion, there is a related configuration using a stopper and a positioning hole disclosed in Japanese Unexamined Utility Model Application, First Publication No. H04-132766 (hereinafter Patent Document 2). Also, for adjustment of a paper storage space, a related configuration using a length size restriction mechanism disclosed in Japanese Unexamined Utility Model Application, First Publication No. H02-103032 (hereinafter Patent Document 3) is disclosed.

However, in the paper feeding cassette disclosed in Patent Document 1, even if the related configurations of Patent Documents 2 and 3 are combined therewith, an operation of fixing or releasing of the sliding cassette to the cassette body cannot be easily performed, and improvement has been anticipated in this regard.

The present disclosure has been made in order to solve any of the above problems, and an example object of the present disclosure is to provide a retractable tray fixing device and a fixing method enabling space saving.

A retractable tray fixing device according to a first example aspect of the present disclosure, for a retractable tray that includes a first tray and a second tray that is slidable relative the first tray, includes: a latch including a beam portion provided along a bottom surface of the second tray and a knob portion provided integrally with the beam portion along a wall portion forming an edge of the second tray; a claw portion provided at a tip position of the beam portion of the latch and inserted into and removed from a through hole penetrating both of the first tray and the second tray; and a latch operating portion that is made of an elastically deformable constituent material, connected to the knob portion of the latch, and operated by an operator's fingertip operation to insert and remove the claw portion into and from the through hole, wherein, in a case in which the knob portion of the latch is pushed toward the wall portion by the operator's fingertip operation to elastically deform the constituent material, the latch operating portion separates the claw portion from the through hole, and in a case in which the operator performs an operation of removing the fingertip, the latch operating portion restores the elastically deformed constituent material to an original shape of the constituent material and inserts the claw portion into the through hole.

A fixing method according to a second example aspect of the present disclosure, for a retractable tray that includes a first tray and a second tray that is slidable relative to the first tray, includes: providing a latch including a beam portion provided along a bottom surface of the second tray and a knob portion provided along a wall portion forming an edge of the second tray; providing a claw portion at a tip position of the beam portion of the latch to be inserted into and removed from a through hole penetrating both of the first tray and the second tray; and providing a latch operating portion that is made of an elastically deformable constituent material, connected to the knob portion of the latch, and operated by an operator's fingertip operation to insert and remove the claw portion into and from the through hole, wherein, in a case in which the knob portion of the latch is pushed toward the wall portion by the operator's fingertip operation to elastically deform the constituent material, the latch operating portion separates the claw portion from the through hole, and in a case in which the operator performs an operation of removing the fingertip, the latch operating portion restores the elastically deformed constituent material to an original shape of the constituent material and inserts the claw portion into the through hole.

In the present disclosure, it is possible to achieve space saving.

EXAMPLE EMBODIMENT

A minimum configuration of a retractable tray fixing device S according to the present disclosure will be described with reference to FIGS. 1A to 1C.

Figure 1A:
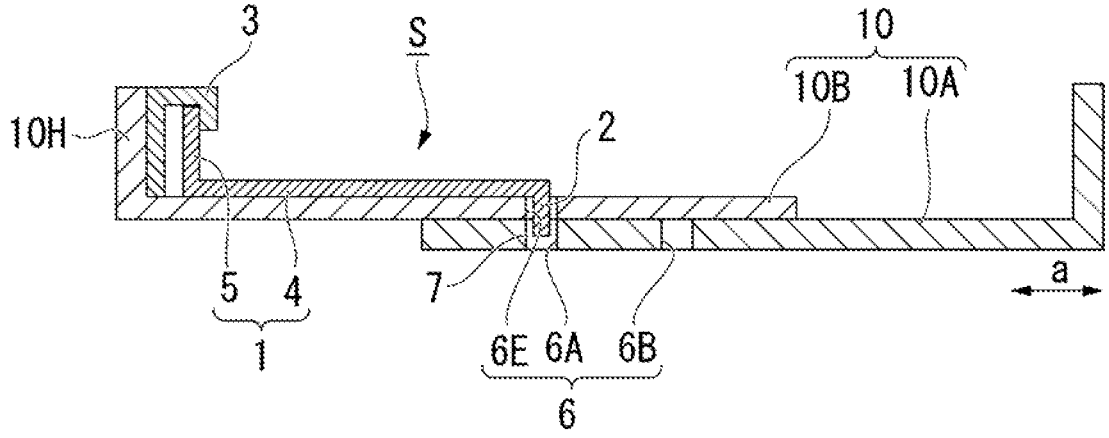
FIG. 1A is a schematic diagram showing a minimum configuration of a retractable tray and a retractable tray fixing device according to the present disclosure, in which a step of operations is shown.

As shown in FIG. 1A, a retractable tray 10 to which the present disclosure is applied has a first tray 10A and a second tray 10B, and is configured such that these trays 10A and 10B overlap each other and slide in arrow a directions, so that the overall length thereof can be changed.

This retractable tray 10 is provided with the retractable tray fixing device S having a latch 1, a claw portion 2, and a latch operating portion 3.

The latch 1 includes a beam portion 4 provided along a bottom surface of the second tray 10B and a knob portion 5 provided along a wall portion 10H forming an edge of the second tray 10B. The knob portion 5 is integral with the beam portion 4.

The claw portion 2 is provided at a tip position of the beam portion 4 of the latch 1. The claw portion 2 is inserted into and removed from a tray hole 6 penetrating the trays 10A and 10B (see FIGS. 1A to 1C).

Figure 1B:
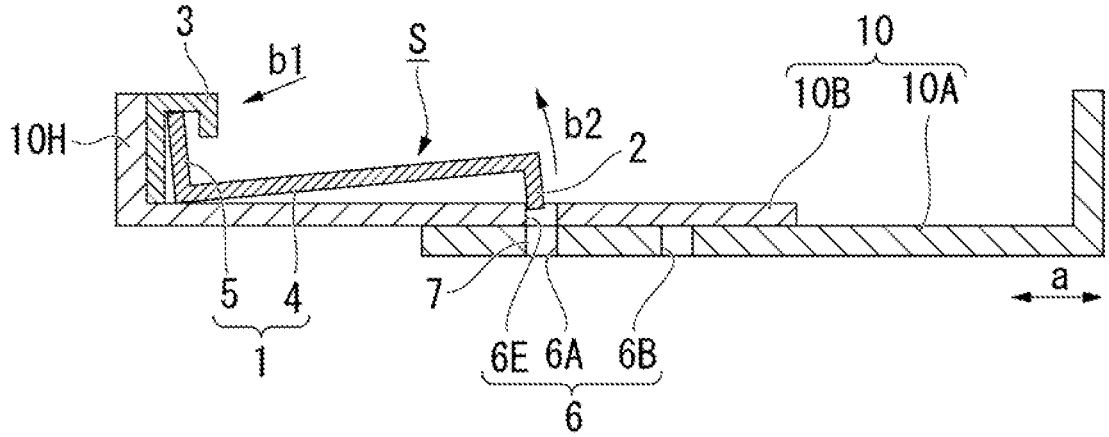
FIG. 1B is a schematic diagram showing a minimum configuration of a retractable tray and a retractable tray fixing device according to the present disclosure, in which a step of operations is shown.
Figure 1C:
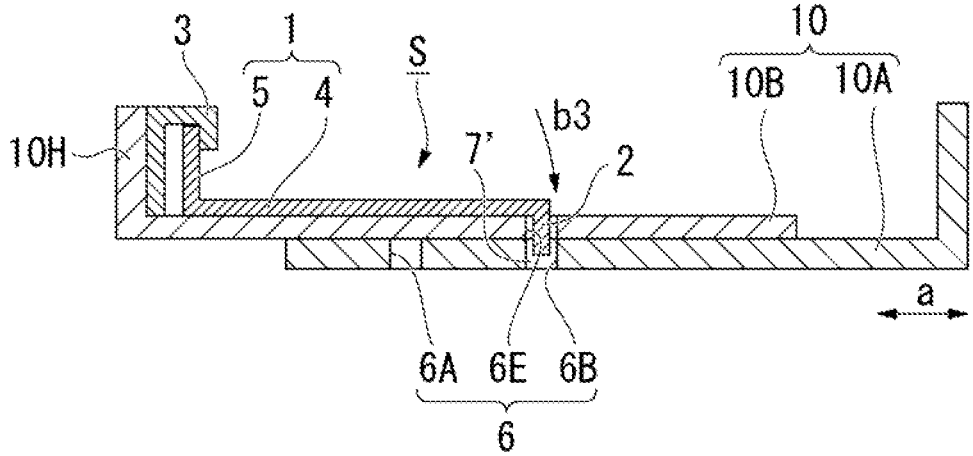
FIG. 1C is a schematic diagram showing a minimum configuration of a retractable tray and a retractable tray fixing device according to the present disclosure, in which a step of operations is shown.

In addition, the tray hole 6 shown in the present example includes tray holes 6A and 6B formed in the first tray 10A at intervals in sliding directions (arrow a directions) and a tray hole 6E formed in the second tray 10B, and by sliding the second tray 10B relative to the first tray 10A, the tray hole 6E of the second tray 10B is selectively connected to the tray hole 6A or 6B of the first tray 10A (see FIGS. 1A to 1C).

Also, FIGS. 1A and 1B show that the tray hole 6E of the second tray 10B is connected with the tray hole 6A of the first tray 10A to form a through hole 7 that passes through both trays 10A and 10B.

The latch operating portion 3 is made of an elastically deformable constituent material, connected to the knob portion 5 of the latch 1, and operated by an operator's fingertip operation to insert and remove the claw portion 2 at a tip of the latch beam portion 4 from the through hole 7 of the trays 10A and 10B (see FIGS. 1A and 1B).

Specifically, in a case in which the knob portion 5 of the latch 1 is pushed toward the wall portion 10H of the tray 10B by the operator's fingertip operation to elastically deform the constituent material, the latch operating portion 3 can separate the claw portion 2 at the tip of the latch beam portion 4 from the through hole 7 of the trays 10A and 10B (see FIG. 1B).

Also, in a case in which the operator performs an operation of removing the fingertip, the latch operating portion 3 can restore the elastically deformed constituent material to its original shape and insert the claw portion 2 into the through hole 7 or 7' of the trays 10A and 10B (FIGS. 1A and 1C).

In the retractable tray fixing device S according to the minimum configuration of the present disclosure described above, the fingertip operation (operation indicated by an arrow b1 in FIG. 1B) of pushing the knob portion 5 of the latch 1 toward the wall portion 10H of the tray 10B is performed in the latch operating portion 3, and thus in a case in which the material constituting the latch operating portion 3 is elastically deformed, the claw portion 2 at the tip of the latch beam portion 4 can be separated from the through hole 7 of the trays 10A and 10B (movement of the claw portion 2 is indicated by an arrow b2).

In this state, the claw portion 2 at the tip of the beam portion 4 of the latch 1 is partly out of the through hole 7 of the trays 10A and 10B, and thus the first tray 10A and the second tray 10B are slidable relative to each other, and the overall length of the trays can be adjusted in accordance with the size of paper (see FIG. 1B).

Also, in a case in which the operation of removing the fingertip from the latch operating portion 3 is performed, the elastically deformed constituent material restores to its original shape, and as indicated by an symbol b3 in FIG. 1C, the claw portion 2 of the latch beam portion 4 can be inserted into the through hole 7' of the trays 10A and 10B after being slid.

Further, in FIG. 1C, an example is shown in which, after lengths of the trays 10A and 10B are adjusted, the tray hole 6E of the second tray 10B is connected to the tray hole 6B of the first tray 10A to form the through hole 7' passing through both the trays 10A and 10B.

Thus, the first tray 10A and the second tray 10B after the length of the entire tray is adjusted are fixed to each other again by the latch 1 (see FIG. 1C).

That is, in the retractable tray fixing device S according to the minimum configuration of the present disclosure, it is possible to perform fixing and releasing of the retractable first and second trays 10A and 10B with a simple operation using only a fingertip of one hand of the operator, and to keep the number of components to a necessary minimum by using simple constituent elements, thereby achieving cost reduction.

In addition, in the retractable tray fixing device S according to the minimum configuration of the present disclosure, since it is not necessary to move the trays 10A and 10B up and down when the first tray 10A and the second tray 10B are fixed and released, it is possible to achieve space saving in the overall structure.

EXAMPLE EMBODIMENTS

The configuration of a retractable tray fixing device S1 according to an example embodiment of the present disclosure will be described with reference to FIGS. 2A to 11B.

Figure 2A:
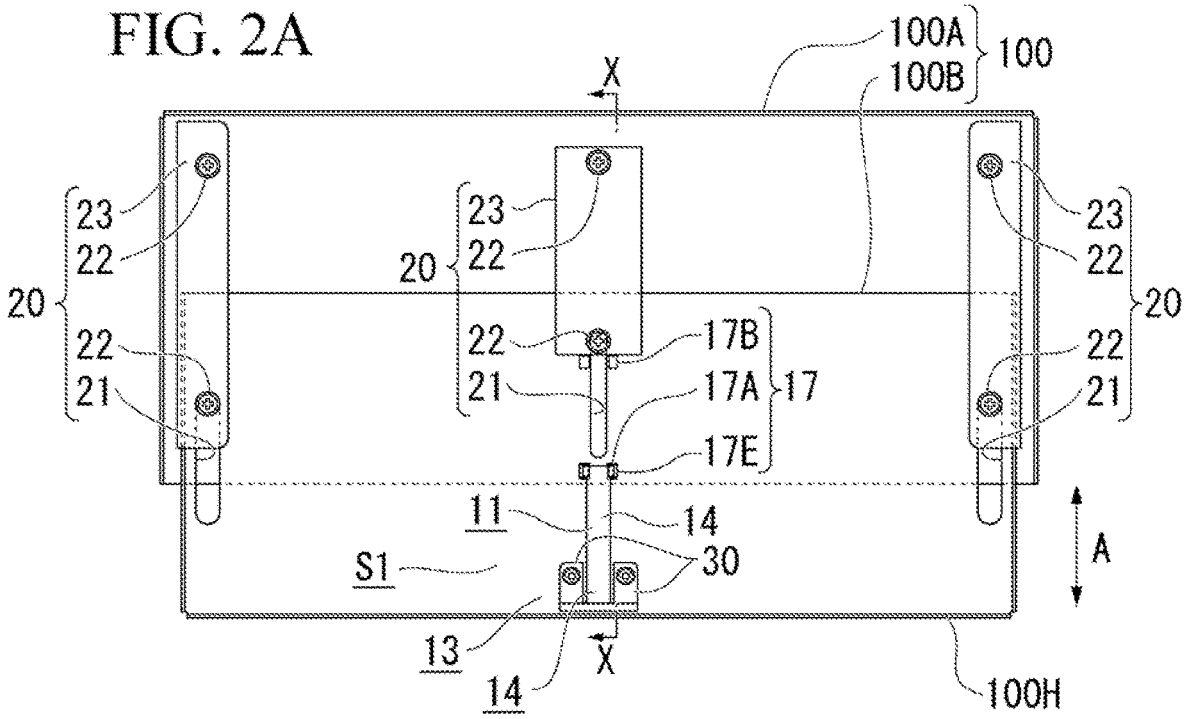
FIG. 2A is a diagram showing an example embodiment of the present disclosure, which is a plan view of the retractable tray and the retractable tray fixing device according to the present disclosure.
Figure 2B:
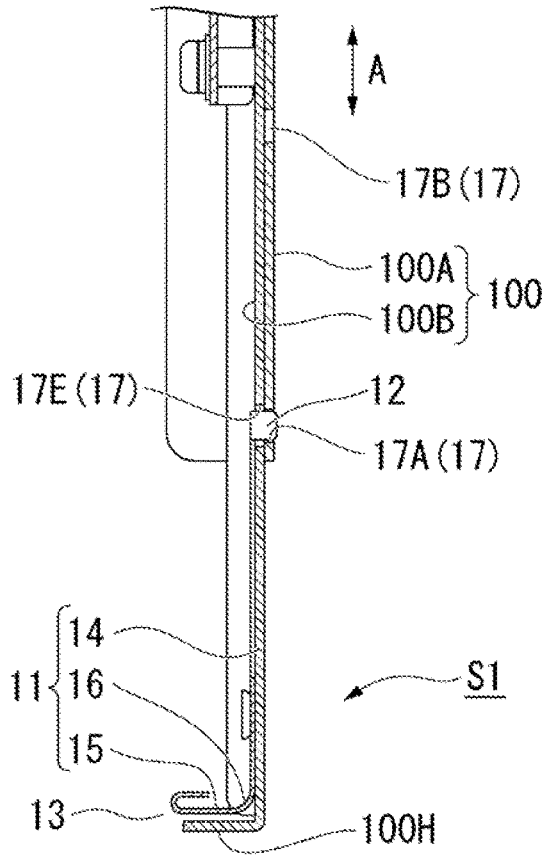
FIG. 2B is a diagram showing an example embodiment of the present disclosure, which is a cross-sectional view along line X-X in FIG. 2A.
Figure 3:
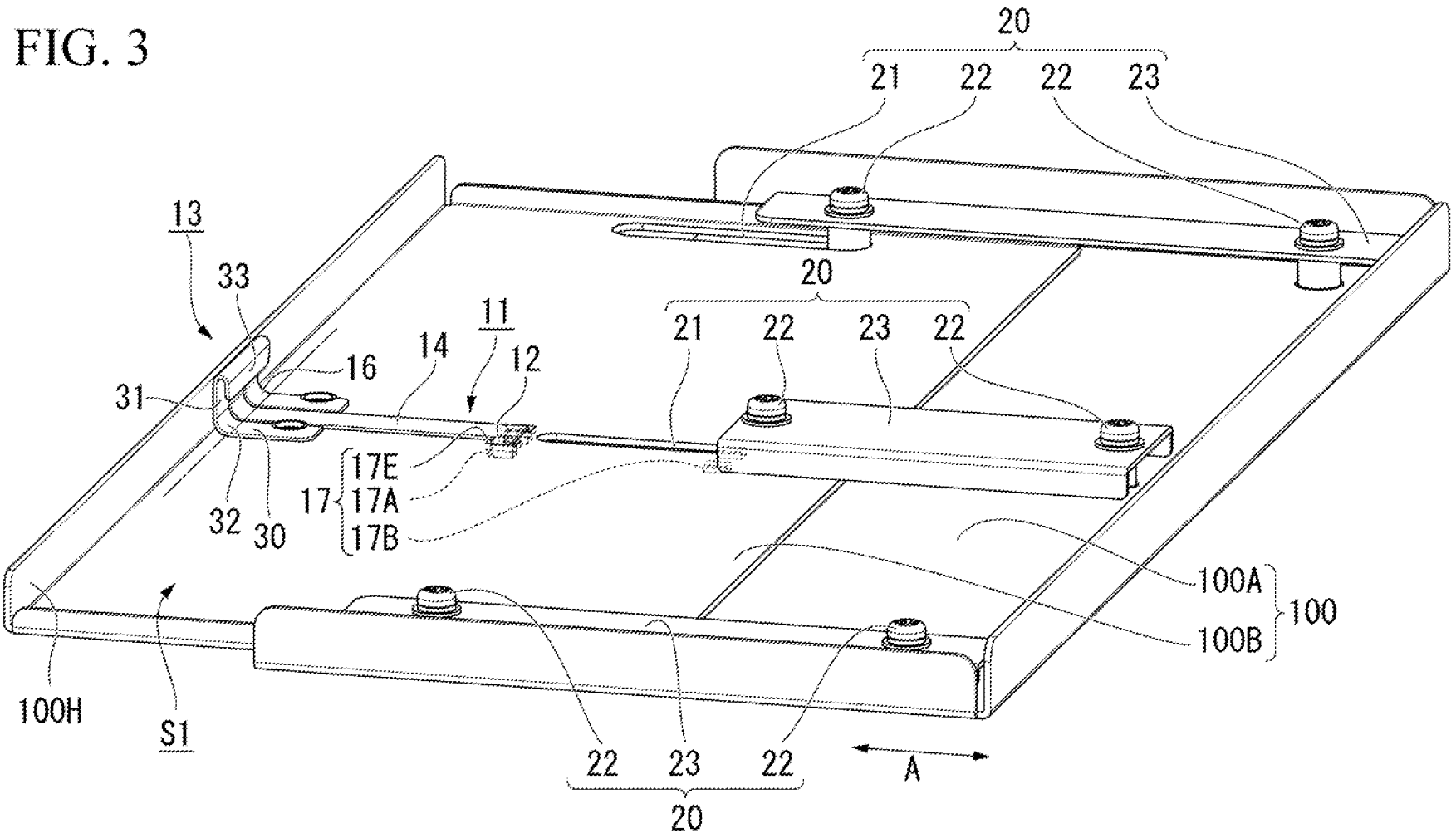
FIG. 3 shows a perspective view of FIG. 2A.

As shown in FIGS. 2A to 3, a retractable tray 100 shown in the example embodiment has a first tray 100A and a second tray 100B.

The first tray 100A is a tray serving as a base. The second tray 100B overlaps an upper surface of the first tray 100A and is provided slidably in arrow A directions, so that the entire length of the retractable tray 100 can be changed by sliding them in the same directions.

Also, sliding means 20 are provided on the first tray 100A and the second tray 100B.

The sliding means 20 each include a guide rail 21 that passes through the second tray 100B and extends in the arrow A directions, which are sliding directions, a guide pin 22 that moves along the guide rail 21, and a pin support member 23 fixed on the first tray 100A to hold the guide pin 22.

In addition, in the sliding means 20, the guide pins 22 are relatively moved along the guide rails 21, so that the second tray 100B can be slid in the arrow A directions on the first tray 100A.

Also, although three sets of sliding means 20 are provided in the present example, it is preferable to provide a plurality of sets, at least two sets of them.

The retractable tray 100 is provided with the retractable tray fixing device S1 having a latch 11, a claw portion 12, and a latch operating portion 13.

Figure 4:
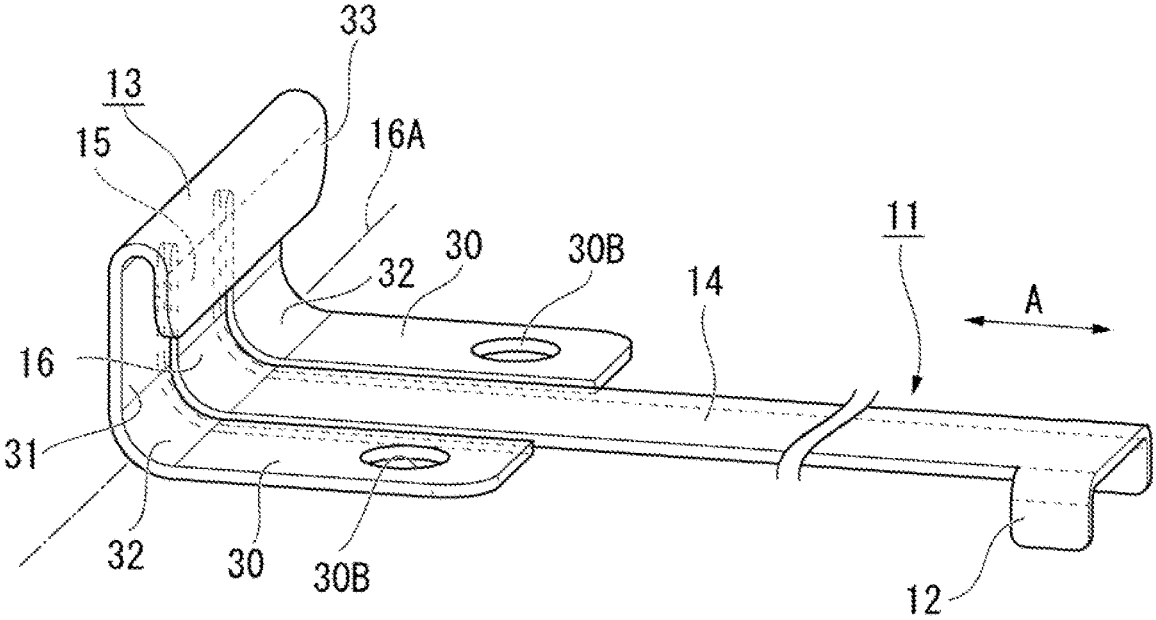
FIG. 4 is a perspective view showing the retractable tray fixing device of FIG. 3.

As shown in detail in FIG. 4, the latch 11 is a structure in which a beam portion 14 provided along a bottom surface of the second tray 100B and a knob portion 15 provided along a wall portion 100H forming an edge of the second tray 100B, are formed as an integral member via a bent portion 16 to be movable. Thus, the knob portion 15 is provided integrally with the beam portion 14.

Also, in the latch 11 of the present example, the beam portion 14 is formed to be long, the knob portion 15 is formed to be short, and they are integrally molded with the bent portion 16 interposed therebetween to form an L-shape as a whole.

Figure 5:
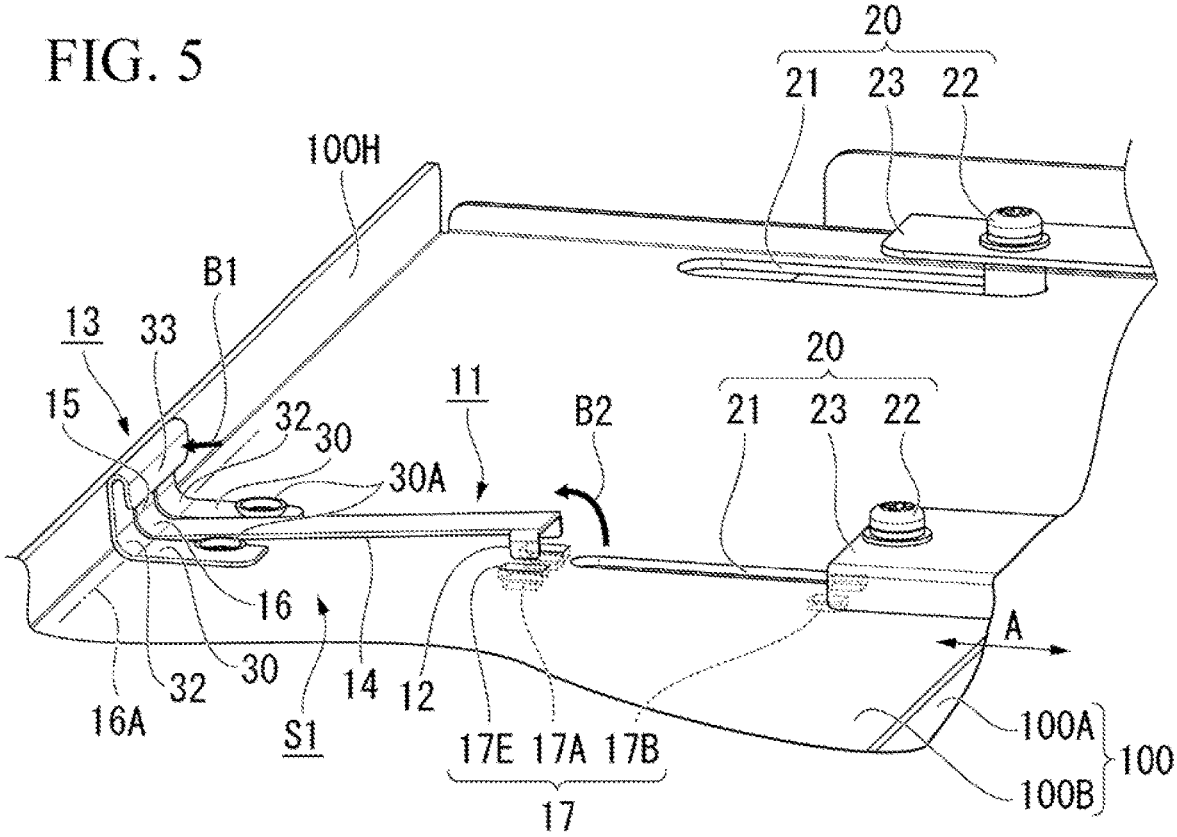
FIG. 5 is a perspective view showing an operation of the retractable tray fixing device of FIGS. 3 and 4.

In addition, as shown in FIGS. 4 and 5, in the latch 11, the knob portion 15 and the beam portion 14 are vertically swingable about a horizontal axis (indicated by reference numeral 16A) in the bent portion 16 located on the bottom surface of the second tray 100B.

Further, the height of the knob portion 15 of the latch 11 is formed to be approximately the same as the height of the wall portion 100H of the second tray 100B on which the knob portion 15 is provided.

Also, the wall portion 100H of the second tray 100B is disposed in a positional relationship in which it is perpendicular to the bottom surface of the second tray 100B.

Further, the latch claw portion 12 is provided at a lower tip position of the latch beam portion 14 and is disposed to be insertable into and removable from the tray holes 17 passing through the trays 100A and 100B.

The tray holes 17 include a plurality of tray holes 17A and 17B (two in the present example) formed individually at intervals in the sliding directions (arrow A directions) in the first tray 100A, and a common tray hole 17E formed in the second tray 100B.

In addition, in the retractable tray 100 as described above, by sliding the second tray 100B in the arrow A directions relative to the first tray 100A, the tray hole 17E of the second tray 100B is selectively connected to either the tray hole 17A or 17B of the first tray 100A (see FIGS. 6A to 9B).

Figure 6A:
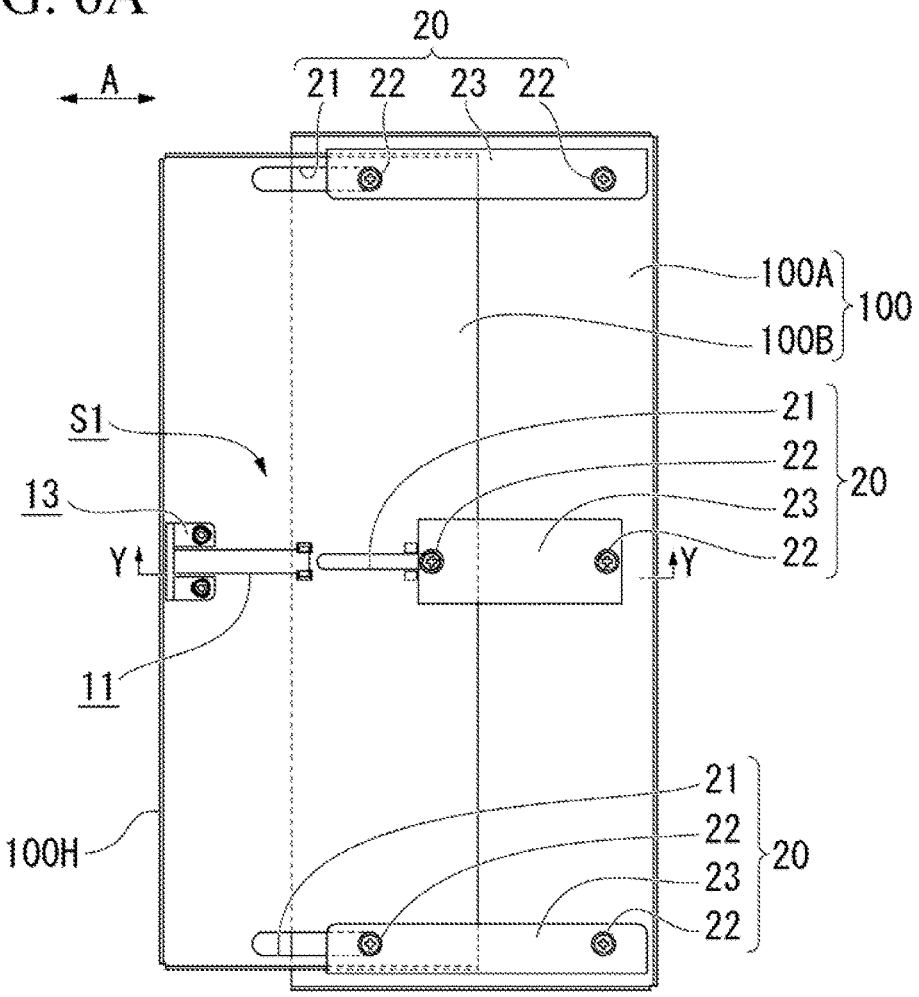
FIG. 6A is a diagram showing the retractable tray with its length extended, which is a plan view.
Figure 6B:
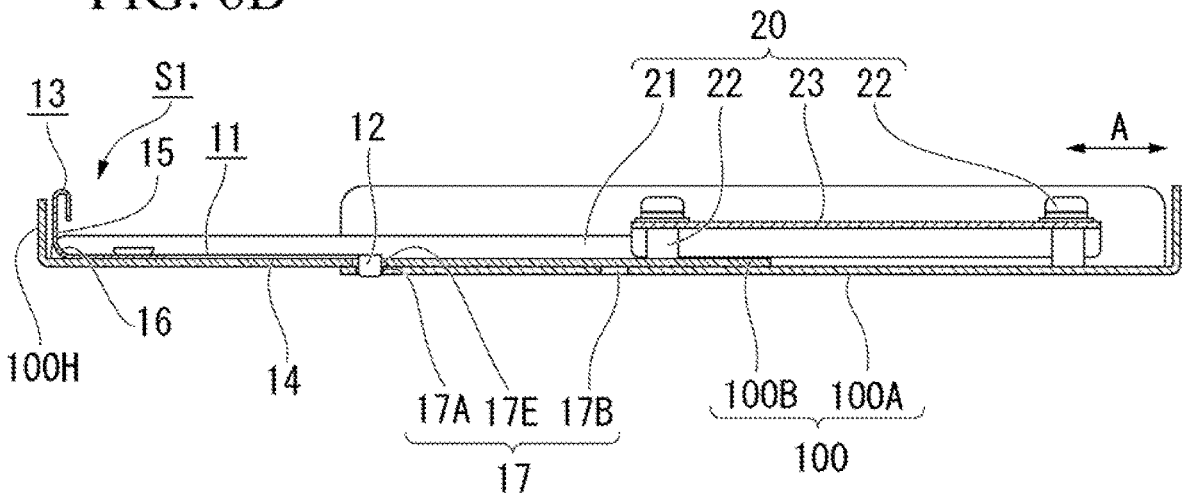
FIG. 6B is a diagram showing the retractable tray with its length extended, which is a cross-sectional view along line Y-Y in FIG. 6A.
Figure 7:
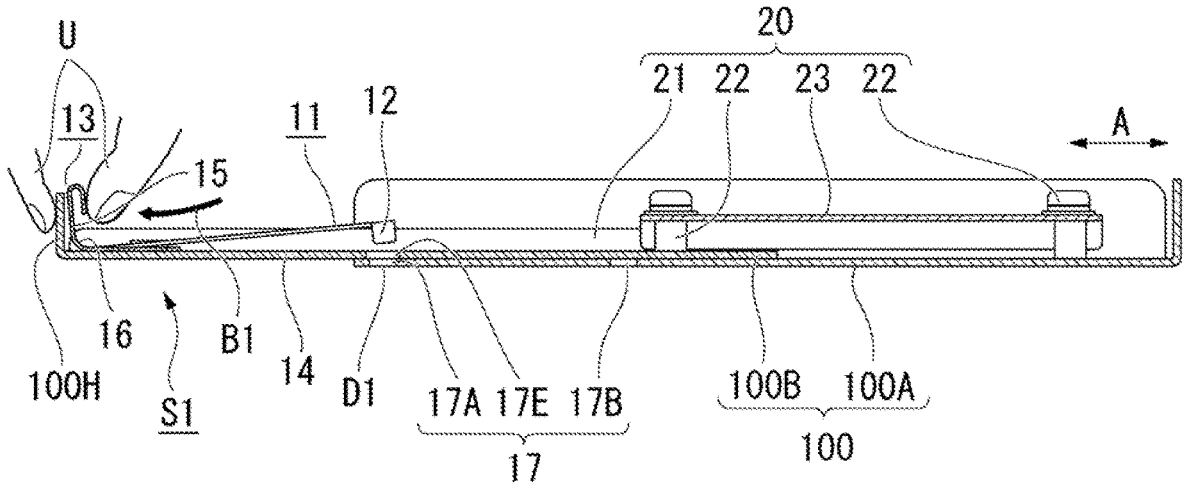
FIG. 7 is a front cross-sectional view of a case in which a knob portion of a latch is pushed toward a wall portion of the tray.

As a specific example, FIGS. 6A to 7 illustrate that the tray hole 17E of the second tray 100B is connected to the tray hole 17A of the first tray 100A such that their axes are aligned with each other, and thus an integral through hole D1 that is continuous while penetrating both trays 100A and 100B is formed.

Figure 8:
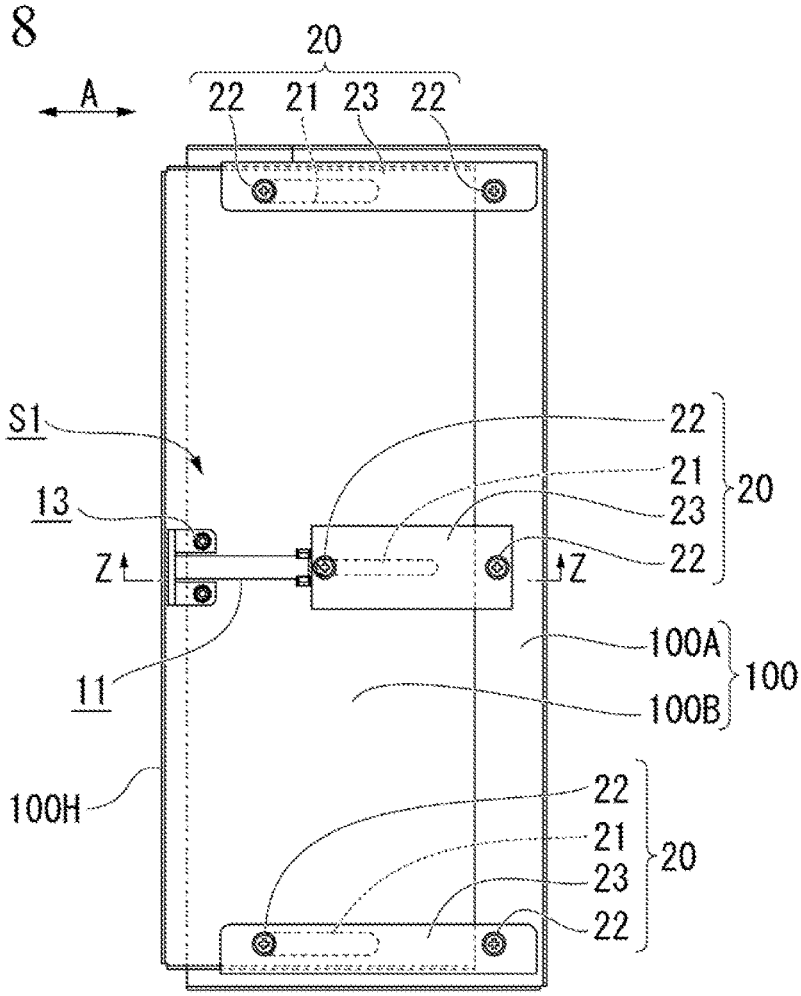
FIG. 8 is a plan view of the retractable tray with its length extended.
Figure 9A:
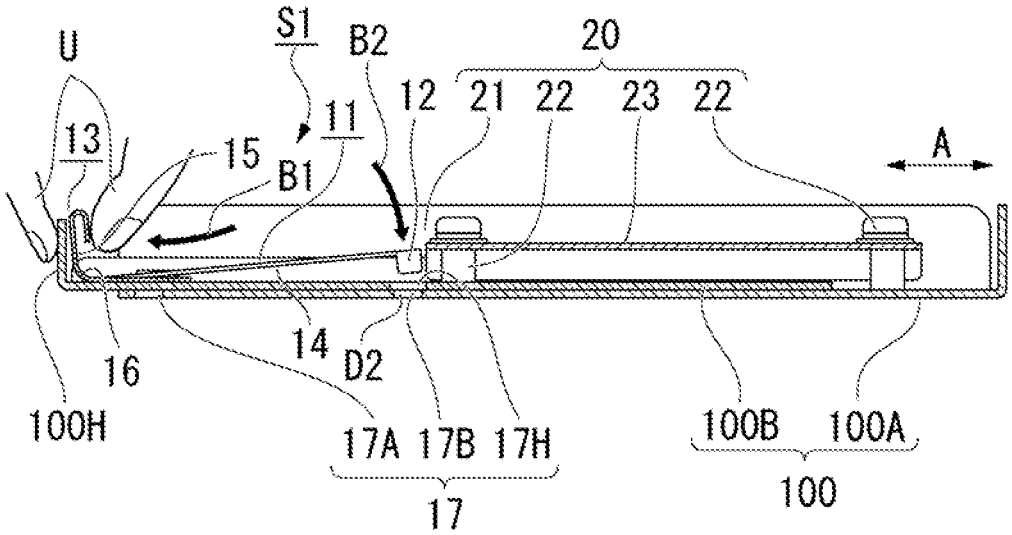
FIG. 9A is a front cross-sectional view of a case in which the knob portion of the latch is pressed with a fingertip.
Figure 9B:
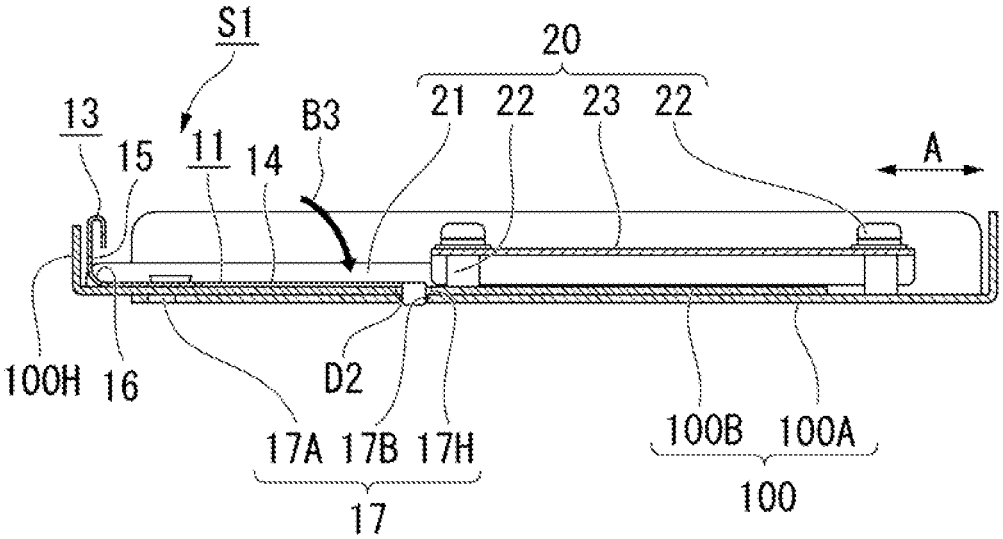
FIG. 9B is a front cross-sectional view of a case in which the fingertip is removed from the knob portion of the latch.

Moreover, FIGS. 8 to 9B illustrate that the tray hole 17E of the second tray 100B is connected to the tray hole 17B of the first tray 100A such that their axes are aligned with each other, and thus an integral through hole D2 that is continuous while penetrating both trays 100A and 100B is formed.

The latch operating portion 13 is made of an elastically deformable constituent material, connected to the knob portion 15 of the latch 11, and operated by the operator's fingertip operation to insert and remove the claw portion 12 at the tip of the latch beam portion 14 into and from the through hole D1 or D2 of the trays 100A and 100B.

Specifically, as shown in detail in FIG. 4, the latch operating portion 13 has fixed portions 30 provided along the latch beam portion 14 and an standing portion 31 provided along the knob portion 15 of the latch 11, and the fixed portions 30 and the standing portion 31 are integrally formed via a bent portion 32 connecting them to each other to form an L-shape as a whole.

The fixed portions 30 are located on both sides of the beam portion 14 to sandwich the latch beam portion 14 and are fixed onto the second tray 100B via attachment holes 30B by fixing means 30A including screws, bolts (not shown), and the like (see FIGS. 4 and 5).

The height of the standing portion 31 is formed to be approximately the same as the height of the wall portion 100H of the second tray 100B, similarly to the knob portion 15 of the latch 11.

An elastically deformable bent portion 33 is provided at a tip of the standing portion 31, and the knob portion 15 of the latch 11 is connected to an inner side of the bent portion 33.

In addition, in the latch operating portion 13, in a case in which the knob portion 15 of the latch 11 is pushed toward the wall portion 100H of the second tray 100B while the bent portion 33 is elastically deformed by the operator's fingertip operation, the claw portion 12 at the tip of the latch beam portion 14 can be separated from the through hole D1 or D2 of the trays 100A and 100B.

Further, in a case in which the operator performs an operation of removing the fingertip from the bent portion 33, the latch operating portion 13 restores the elastically deformed bent portion 33 to its original shape, so that the claw portion 12 can be inserted into the through hole D1 or D2 of the trays 100A and 100B (which will be described later with reference to FIGS. 7 to 9B).

In the retractable tray fixing device S1 according to the present example embodiment described above, in a case in which an operation of the fingertip (operation of a fingertip U indicated by an arrow B1 in FIG. 7) is performed to push the knob portion 15 of the latch 11 toward the wall portion 100H of the tray 100B in the bent portion 33 of the latch operating portion 13 and the constituent material of the latch operating portion 13 is elastically deformed, the claw portion 12 at the tip of the latch beam portion 14 can be separated from the through hole D1 of the trays 100A and 100B (movement of the claw portion 12 is indicated by an arrow B2).

In this state, since the claw portion 12 at the tip of the latch beam portion 14 is out of the through hole D1 of the trays 100A and 100B, the restriction on the movement of the retractable tray 100 is released.

Thus, the first tray 100A and the second tray 100B can slide relative to each other, and the overall length of the trays can be adjusted in accordance with the size of the paper (see FIGS. 6A, 6B and 8).

In addition, in a case in which the operation of removing the fingertip U from the latch operating portion 13 is performed, the elastically deformed constituent material restores to its original shape, and as indicated by reference numeral B3 in FIGS. 9A and 9B, the claw portion 12 of the latch beam portion 14 can be inserted into the through hole D2 of the trays 100A and 100B after being slid.

Thus, the first tray 100A and the second tray 100B after the length of the entire trays is adjusted are again fixed to each other by the latch 11 (see FIG. 9B).

That is, in the retractable tray fixing device S1 according to the example embodiment, it is possible to perform fixing and releasing of the retractable first tray 100A and second tray 100B with a simple operation using only the fingertip U of one hand of the operator, and to keep the number of component to the necessary minimum by using simple constituent elements, thereby achieving cost reduction.

Further, in the retractable tray fixing device S1, since it is not necessary to move the trays 100A and 100B up and down when the first tray 100A and the second tray 100B are fixed and released, it is also possible to achieve space saving in the overall structure.

As a result, in the retractable tray fixing device S1, a thin tray with a thickness of about 10 mm that can be expanded and contracted can be realized with a simple structure.

Modified Example 1

In the retractable tray 100 shown in the above example embodiment, two tray holes 17 (17A and 17B) are provided in the first tray 100A at intervals in the sliding directions (arrow A directions), but the number is not limited to two.

For example, in the retractable tray 100 shown in FIGS. 10A to 11B, four tray holes 17' (17A to 17D) are provided in the first tray 100A at regular intervals in the sliding directions (arrow A directions).

Figure 10A:
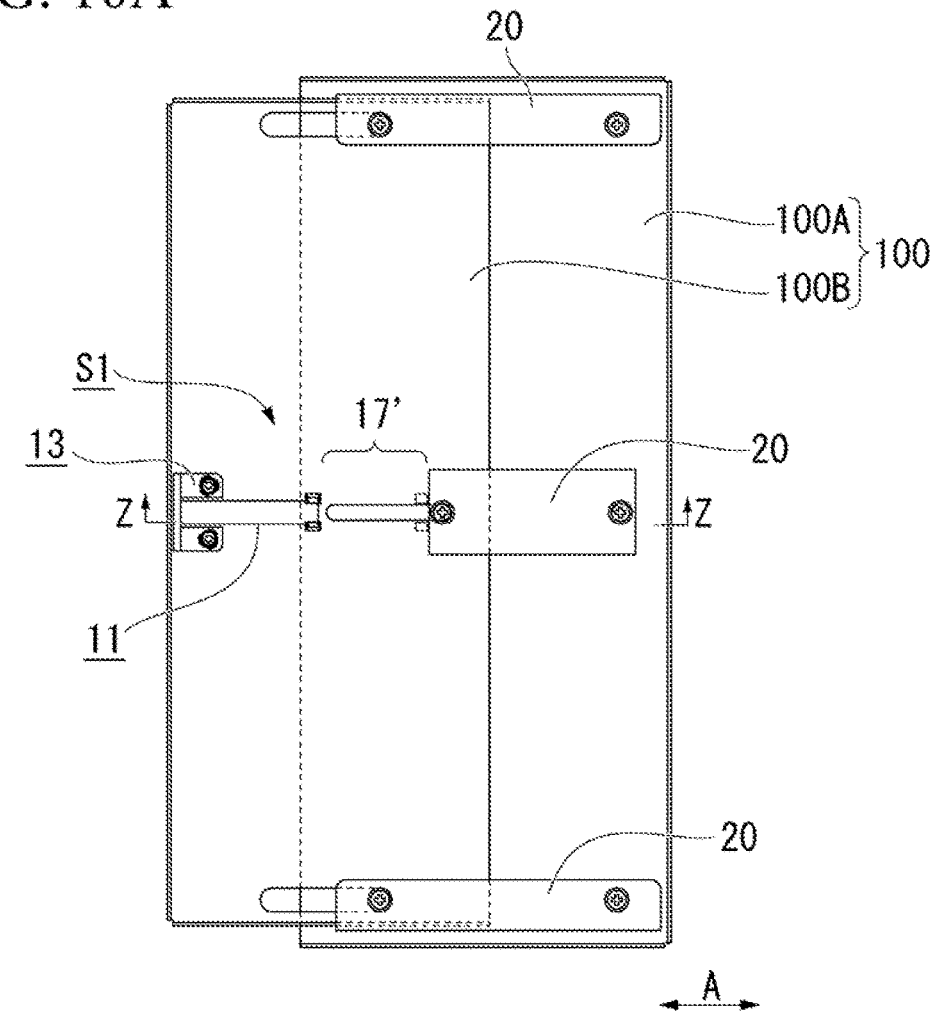
FIG. 10A is a diagram showing a modified example of the example embodiment of the present disclosure, which is a plan view of a retractable tray and a retractable tray fixing device.
Figure 10B:
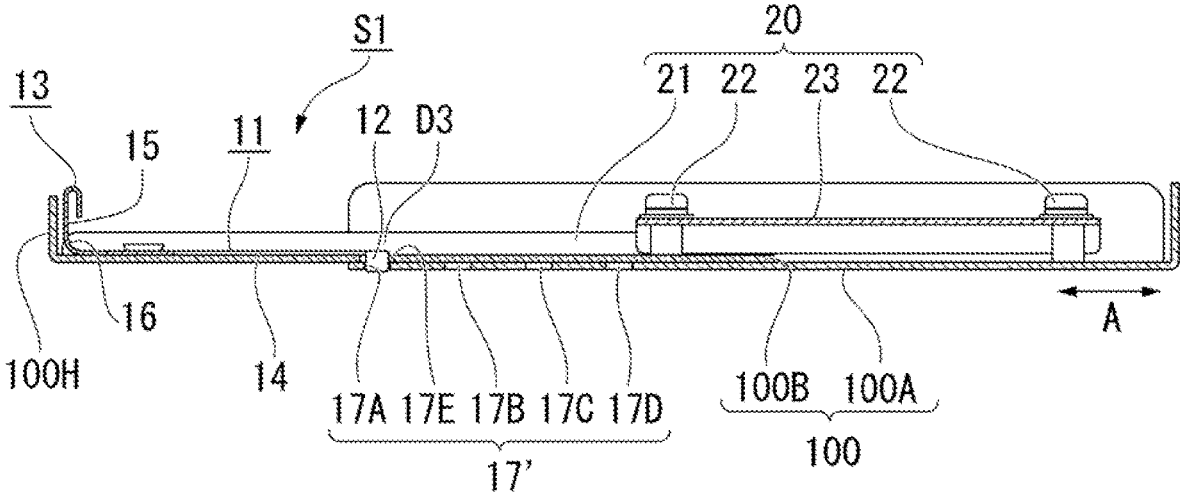
FIG. 10B is a diagram showing a modified example of the example embodiment of the present disclosure, which is a cross-sectional view along line Z-Z in FIG. 10A.

Thus, in the retractable tray 100, as shown in FIG. 10B, it is illustrated that the tray hole 17E of the second tray 100B is connected to the tray hole 17A of the first tray 100A such that their axes are aligned with each other, and thus a through hole D3 penetrating both the trays 100A and 100B is formed.

Figure 11A:
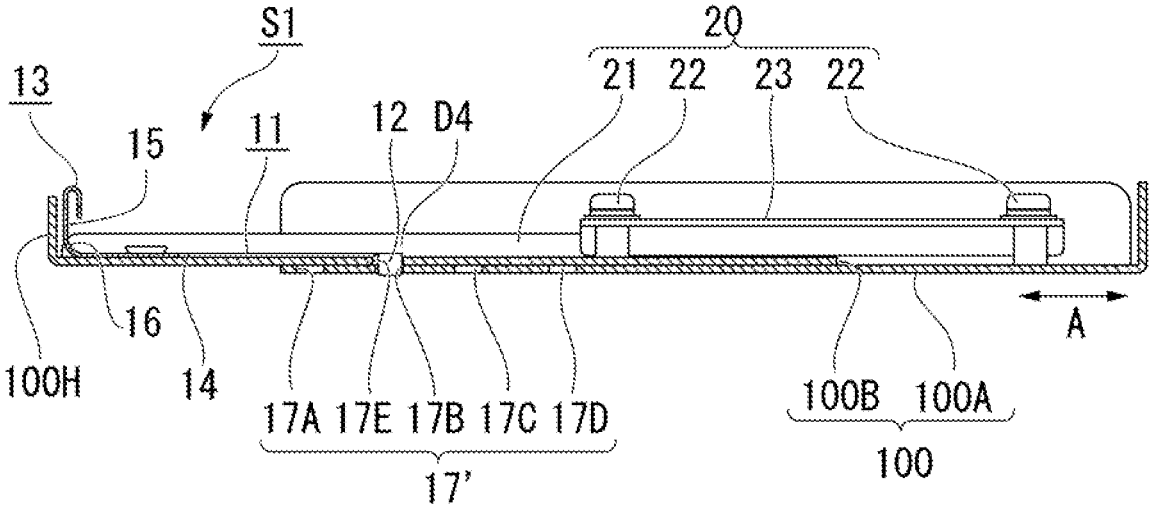
FIG. 11A is a cross-sectional view showing an operation of the retractable tray fixing device shown in FIGS. 10A and 10B, which is a diagram showing a fixed pattern 1.

Also, in the retractable tray 100, as shown in FIG. 11A, it is illustrated that the tray hole 17E of the second tray 100B is connected to the tray hole 17B of the first tray 100A such that their axes are aligned with each other, and thus a through hole D4 penetrating both the trays 100A and 100B is formed.

Figure 11B:
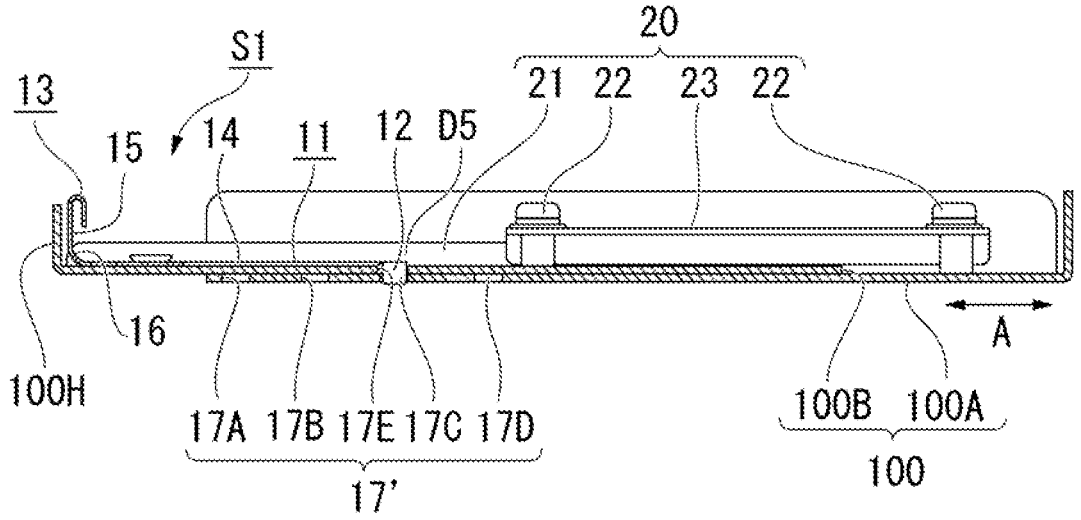
FIG. 11B is a cross-sectional view showing an operation of the retractable tray fixing device shown in FIGS. 10A and 10B, which is a diagram showing a fixed pattern 2.

In addition, in the retractable tray 100, as shown in FIG. 11B, it is illustrated that the tray hole 17E of the second tray 100B is connected to the tray hole 17C of the first tray 100A such that their axes are aligned with each other, and thus a through hole D5 penetrating both the trays 100A and 100B is formed.

As a result, in the retractable tray 100 shown in FIGS. 10A to 11B, the lengths of the trays 100A and 100B can be set in multiple stages, and various types of paper can be handled.

Modified Example 2

In the above example embodiment, the latch 11 is made swingable around the horizontal axis 16A (see FIG. 4) located on a tangential line between the second tray 100B and the bent portion 16 of the latch 11. This horizontal axis 16A may be constituted by an actual shaft body to rotatably support the latch 11.

Modified Example 3

In the above example embodiment, the bent portion 33 of the latch operating portion 13 is provided to be connected to the knob portion 15 of the latch 11. In this case, the latch operating portion 13 and the latch 11 may be integrally molded with the same member, or may be formed as individual bodies.

As described above, the example embodiment of the present disclosure has been described in detail with reference to the drawings, but specific configurations are not limited to this example embodiment, and design changes and the like are also included within the scope of the present disclosure.

An example object of the present disclosure is to provide a retractable tray fixing device and a fixing method in which it is possible to perform fixing and releasing of a tray with a simple one-handed operation and to minimize the number of components, thereby enabling space saving and cost reduction.

In the present disclosure, it is possible to perform fixing and releasing of the retractable first and second trays with a simple operation using only a fingertip of one hand of the operator, and to keep the number of components to a necessary minimum by using simple constituent elements, thereby achieving space saving and cost reduction.

The present disclosure relates to a retractable tray fixing device and a fixing method in which lengths of two trays can be freely reduced or increased depending on the intended uses.

What is claimed is:

1. A retractable tray fixing device for a retractable tray that includes a first tray and a second tray that is slidable relative to the first tray, the retractable tray fixing device comprising:

a latch including a beam portion provided along a bottom surface of the second tray and a knob portion provided integrally with the beam portion along a wall portion forming an edge of the second tray;

a claw portion provided at a tip position of the beam portion of the latch and inserted into and removed from a through hole penetrating both of the first tray and the second tray; and a latch operating portion that is made of an elastically deformable constituent material, connected to the knob portion of the latch, and operated by an operator's fingertip operation to insert and remove the claw portion into and from the through hole, wherein, in a case in which the knob portion of the latch is pushed toward the wall portion by the operator's fingertip operation to elastically deform the constituent material, the latch operating portion separates the claw portion of the latch from the through hole, and in a case in which the operator performs an operation of removing the fingertip, the latch operating portion restores the elastically deformed constituent material to an original shape of the constituent material and inserts the claw portion into the through hole.

2. The retractable tray fixing device according to claim 1, wherein the latch is supported such that the beam portion is swingable vertically around a horizontal axis located on the bottom surface of the second tray.

3. The retractable tray fixing device according to claim 1, wherein the latch includes the beam portion formed to be long and the knob portion formed to be short, and forms an L-shape as a whole.

4. The retractable tray fixing device according to claim 1, wherein the latch operating portion is integral with the latch.

5. The retractable tray fixing device according to claim 1, wherein the latch operating portion is formed as an individual body from the latch.

6. The retractable tray fixing device according to claim 1, wherein the through hole includes a single common tray hole formed in the second tray and a plurality of individual tray holes formed at intervals in the first tray, and axes of the common tray hole and one of the individual tray holes are aligned with each other to form the through hole.

7. The retractable tray fixing device according to claim 1, wherein the latch operating portion is formed in an L-shape to conform to a shape of the latch and has a fixed portion provided along the beam portion of the latch and a standing portion provided along the knob portion of the latch, and an elastically deformable bent portion is provided at a tip of the standing portion, and the knob portion of the latch is connected to an inner side of the bent portion.

8. The retractable tray fixing device according to claim 7, wherein the latch operating portion is configured such that the fixed portion disposed along the beam portion of the latch is fixed on the bottom surface of the second tray.

9. The retractable tray fixing device according to claim 1, wherein the first tray and the second tray are provided with guide rails formed in sliding directions and guide pins that move along the guide rails.

10. A fixing method for a retractable tray that includes a first tray and a second tray that is slidable relative to the first tray, the method comprising:

providing a latch including a beam portion provided along a bottom surface of the second tray and a knob portion provided along a wall portion forming an edge of the second tray;

providing a claw portion at a tip position of the beam portion of the latch to be inserted into and removed from a through hole penetrating both of the first tray and the second tray; and providing a latch operating portion that is made of an elastically deformable constituent material, connected to the knob portion of the latch, and operated by an operator's fingertip operation to insert and remove the claw portion into and from the through hole, wherein, in a case in which the knob portion of the latch is pushed toward the wall portion by the operator's fingertip operation to elastically deform the constituent material, the latch operating portion separates the claw portion from the through hole, and in a case in which the operator performs an operation of removing the fingertip, the latch operating portion restores the elastically deformed constituent material to an original shape of the constituent material and inserts the claw portion into the through hole.

* * * * *